US011164711B2

(12) United States Patent
Chen et al.

(10) Patent No.: US 11,164,711 B2
(45) Date of Patent: Nov. 2, 2021

(54) DC CONTACTOR WITH DUAL MICRO SWITCHES

(71) Applicant: Xiamen Hongfa Electric Power Controls Co., Ltd., Xiamen (CN)

(72) Inventors: Songsheng Chen, Xiamen (CN); Shuming Zhong, Xiamen (CN); Shengsheng Shi, Xiamen (CN)

(73) Assignee: Xiamen Hongfa Electric Power Controls Co., Ltd., Fujian (CN)

( * ) Notice: Subject to any disclaimer, the term of this patent is extended or adjusted under 35 U.S.C. 154(b) by 290 days.

(21) Appl. No.: 16/338,265

(22) PCT Filed: Sep. 28, 2017

(86) PCT No.: PCT/CN2017/103931

§ 371 (c)(1),
(2) Date: Mar. 29, 2019

(87) PCT Pub. No.: WO2018/059479

PCT Pub. Date: Apr. 5, 2018

(65) Prior Publication Data

US 2020/0035432 A1 Jan. 30, 2020

(30) Foreign Application Priority Data

Sep. 29, 2016 (CN) ..... 201610863895.0

(51) Int. Cl.
*H01H 50/54* (2006.01)
*H01H 50/08* (2006.01)
(Continued)

(52) U.S. Cl.
CPC ..... *H01H 50/08* (2013.01); *H01H 50/04* (2013.01); *H01H 50/18* (2013.01); *H01H 50/44* (2013.01);
(Continued)

(58) Field of Classification Search
CPC ... H01H 15/107; H01H 50/545; H01H 71/465
See application file for complete search history.

(56) References Cited

U.S. PATENT DOCUMENTS 4,356,368 A * 10/1982 Osika ..... H01H 50/545 200/307
5,012,215 A * 4/1991 Floc'h ..... H01H 1/5805 335/132
(Continued)

FOREIGN PATENT DOCUMENTS

CN 86210311 U 12/1987
CN 101159201 A 4/2008
(Continued)

OTHER PUBLICATIONS

Chinese Office Action received in CN Application No. 20160863895.0 dated Feb. 1, 2018.
(Continued)

*Primary Examiner* — Alexander Talpalatski
(74) *Attorney, Agent, or Firm* — Wolf, Greenfield & Sacks, P.C.

(57) ABSTRACT

A DC contactor with dual micro switches, characterized in that, comprising: a coli, a push rod and two micro switches, the two micro switches are respectively installed at two predetermined positions in the contactor, the push rod is provided with two toggle arms respectively matched with the two micro switches, when main contacts of the contactor are in contact, the two micro switches turn on or off or convert contact by the toggle arms of the push rod according to a predetermined means.

9 Claims, 5 Drawing Sheets

(51) Int. Cl.

| | |
|---|---|
| ***H01H 50/04*** | (2006.01) |
| ***H01H 50/18*** | (2006.01) |
| ***H01H 50/44*** | (2006.01) |
| ***H01H 50/56*** | (2006.01) |
| ***H01H 50/60*** | (2006.01) |

(52) U.S. Cl.
CPC ..... *H01H 50/545* (2013.01); *H01H 50/56* (2013.01); *H01H 50/60* (2013.01)

(56) References Cited

U.S. PATENT DOCUMENTS

| | | | | |
|---|---|---|---|---|
| 9,978,551 | B2 * | 5/2018 | Chen | H01H 51/2236 |
| 2015/0162147 | A1 * | 6/2015 | Nguyen | H01H 21/22 200/335 |

FOREIGN PATENT DOCUMENTS

| | | | |
|---|---|---|---|
| CN | 201741639 | U | 2/2011 |
| CN | 202443919 | U | 9/2012 |
| CN | 105280440 | A | 1/2016 |
| CN | 105551898 | A | 5/2016 |
| CN | 206116291 | U | 4/2017 |
| CN | 205335187 | U | 6/2018 |
| CN | 205354959 | U | 6/2018 |
| EP | 0323461 | A1 | 7/1989 |
| EP | 1353348 | A1 | 10/2003 |
| GB | 2156156 | A | 10/1985 |
| JP | H0887940 | A | 4/1996 |

OTHER PUBLICATIONS

Extended European Search Report received in EP App. No. 17854929.1 dated Apr. 23, 2020.

* cited by examiner

DC CONTACTOR WITH DUAL MICRO SWITCHES

CROSS REFERENCE

This application is a national stage entry of PCT Application No. PCT/CN2017/103931 filed Sep. 28, 2017, which is based upon and claims priority to Chinese Patent Application No. 201610863895.0, filed on Sep. 29, 2016, the entire contents thereof are incorporated herein by reference.

TECHNICAL FIELD

The present disclosure relates to a DC contactor, and in particular, to a DC contactor with dual micro switches.

BACKGROUND

A contactor is an automated control device that generates a magnetic field when a current flows through a coil to close the contacts so as to achieve control of the load.

The DC contactor usually includes a main contact (including a main movable contact and a main stationary contact) for connecting the load so as to perform on-off control of the load, wherein the main stationary contact is mounted at the leading-out terminal, and the main movable contact is provided at the movable spring and mounted at the push rod, when the coil is excited, the push rod drives the movable spring to move, so that the main movable contact and the main stationary contact are in contact. In order to detect the on-off condition of the main contacts, the DC contactor in the related art usually further has a set of auxiliary contacts which is usually implemented by a micro switch, that is, the DC contactor in the related art is provided with a micro switch for detecting the on-off condition of the main contact, in order to implement the design, a toggle arm is mounted at the push rod, and the micro switch is installed at a corresponding position in the DC contactor, when the push rod drives the movable spring to make the main movable contact and the main stationary contact are in contact, the push rod simultaneously drives the toggle arm to move as so to touch the movable arm of the micro switch, therefore, the micro switch could turn on or off, the on/off signal of the micro switch is detected by the circuit board of the DC contactor, thereby detecting the on/off condition of the main contact. The DC contactors of the related art are usually also provided with an energy saving scheme, the energy saving scheme of the existing DC contactor is realized by the control of the circuit board, and the driving of the relay coil is performed by the driving circuit in the circuit board, the driving circuit is mainly composed of two parts: the first part is composed of a charging and discharging circuit composed of a high-power MOSFET, a stabilivolt, a resistor and a capacitor, which is used to provide a large enough excitation current by which the relay could be operated reliably in a long enough excitation time; the second part is composed of a resistor, a stabilivolt and a small-power MOSFET, which is used to provide a continuous and sufficiently large excitation current by which the relay can be remained operating until the external power supply is powered down. In this way, the relay could be operated reliably under a short high-energy excitation current, and then switches to an operation under a low-energy holding current, so as to achieve energy-saving control purposes. The above energy saving method in the related art achieved by the control of the circuit board has the disadvantages of complicated circuit structure and poor applicability.

SUMMARY

The purpose of the embodiment of the present disclosure is to overcome the deficiencies of the related art and provide a DC contactor with dual micro switches, using the dual micro switches, on the one hand, it is ensured that the detection to the on/off condition of the main contacts could be achieved.

Using the dual micro switches, on the other hand, can also achieve the effect of energy saving, thereby it is realized that the complicated circuit structure used for energy saving control in the circuit board can be eliminated, thusly having good applicability.

The technical solution adopted by the embodiment of the present disclosure to solve the technical problem thereof is: a DC contactor with dual micro switches including a coli, a push rod and two micro switches, the two micro switches are respectively installed at two predetermined positions in the contactor, the push rod is provided with two toggle arms respectively matched with the two micro switches, when a main contacts of the contactor are in contact, the two micro switches turns on or off or converts contact by the toggle arms of the push rod according to a predetermined means.

According to one embodiment, the two micro switches are respectively a first micro switch for detecting an on/off condition of the main contacts and a second micro switch for realizing energy saving, the second micro switch is a normally closed micro switch, when the coil is excited, the push rod pushes the main movable contact of the contactor to move and contact the main stationary contact, then one toggle arm of the push rod drives a contact arm of the first micro switch to move so as to cause the first micro switch to turn on or off; the other toggle arm of the push rod drives a contact arm of the second micro switch to move so as to cause the second micro switch to turn off.

According to one embodiment, one of the toggle arms of the push rod is a first toggle arm, and the other toggle arm is a second toggle arm; the coil includes a holding coil and an acceleration coil, the acceleration coil and the normally closed second micro switch are connected in series, and the components connected in series are connected in parallel with the holding coil; when the main contacts of the contactor are in contact, the second toggle arm of the push rod drives the contact arm of the second micro switch to move so as to turn off the power supply of the acceleration coil, thereby achieving energy saving.

According to one embodiment, the coil is designed to be a structure having an inner ring and an outer ring, the holding coil is the inner ring, and the acceleration coil is the outer ring.

According to one embodiment, the push rod includes a spring seat and a rod body, one end of the rod body is fixedly connected to the spring seat, and the first toggle arm and the second toggle arm are respectively connected to the spring seat.

According to one embodiment, the contactor further includes a ceramic cover in which the main contact is accommodated, the first micro switch and the second micro switch are respectively disposed at two sides of the outside of the ceramic cover, the spring seat of the push rod is also accommodated in the cavity of the ceramic cover, the first toggle arm and the second toggle arm respective protrude from the cavity of the ceramic cover to two sides of the outside of the ceramic cover and correspondingly cooperate with the first micro switch and the second micro switch respectively.

According to one embodiment, the first toggle arm, the second toggle arm and the spring seat are integrally connected by injection molding.

According to one embodiment, the spring seat further has a fixing piece embedded therein by injection molding.

Compared with the related art, the beneficial effects of the embodiments of the present disclosure are:

1. In the embodiment of the present disclosure, two micro switches are respectively disposed in the DC contactor, and the two micro switches are respectively installed in two predetermined positions in the DC contactor, and the two toggle arms provided by the push rod are matched with the two micro switches, when the main contacts of the contactor are in contact, the two micro switches can turn on or off in a predetermined manner by the push rod of the two toggle arms, thereby realizing the function of the two sets of auxiliary contacts.

2. The embodiment of the present disclosure adopts a normally closed second micro switch, and the coil includes a holding coil and an acceleration coil, the acceleration coil and the normally closed second micro switch are connected in series, and the components connected in series are connected in parallel with the holding coil; at the same time, the push rod is provided with a second toggle arm for cooperating with the second micro switch, when the coli is excited, the push rod is driven to move till the main contacts are closed, then the normally closed second micro switch turns off, after the normally closed second micro switch turns off, the acceleration coil doesn't operate, but only the holding coil operates, thereby achieving the effect of energy saving. The disclosure adopts the second toggle arm of the push rod to cooperate with the normally closed second micro switch to achieve the energy-saving effect, thereby realizing the elimination of a complicated circuit structure used for performing power saving in a circuit board in the related art, and providing a simpler circuit structure and better applicability.

The present disclosure will be further described in detail below with reference to the accompanying drawings and embodiments. However, a DC contactor with dual micro switches in accordance with an embodiment of the present disclosure is not limited to the embodiment,

DETAILED DESCRIPTION

Figure 1:
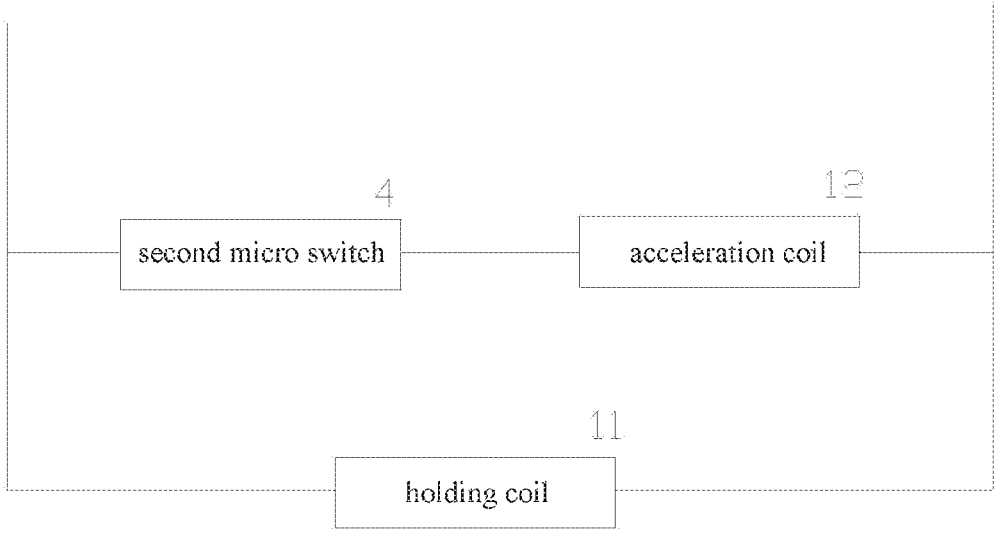
FIG. 1 is a schematic view illustrating the electrical connection of a second micro switch and a coil according to an embodiment of the present disclosure.
Figure 2:
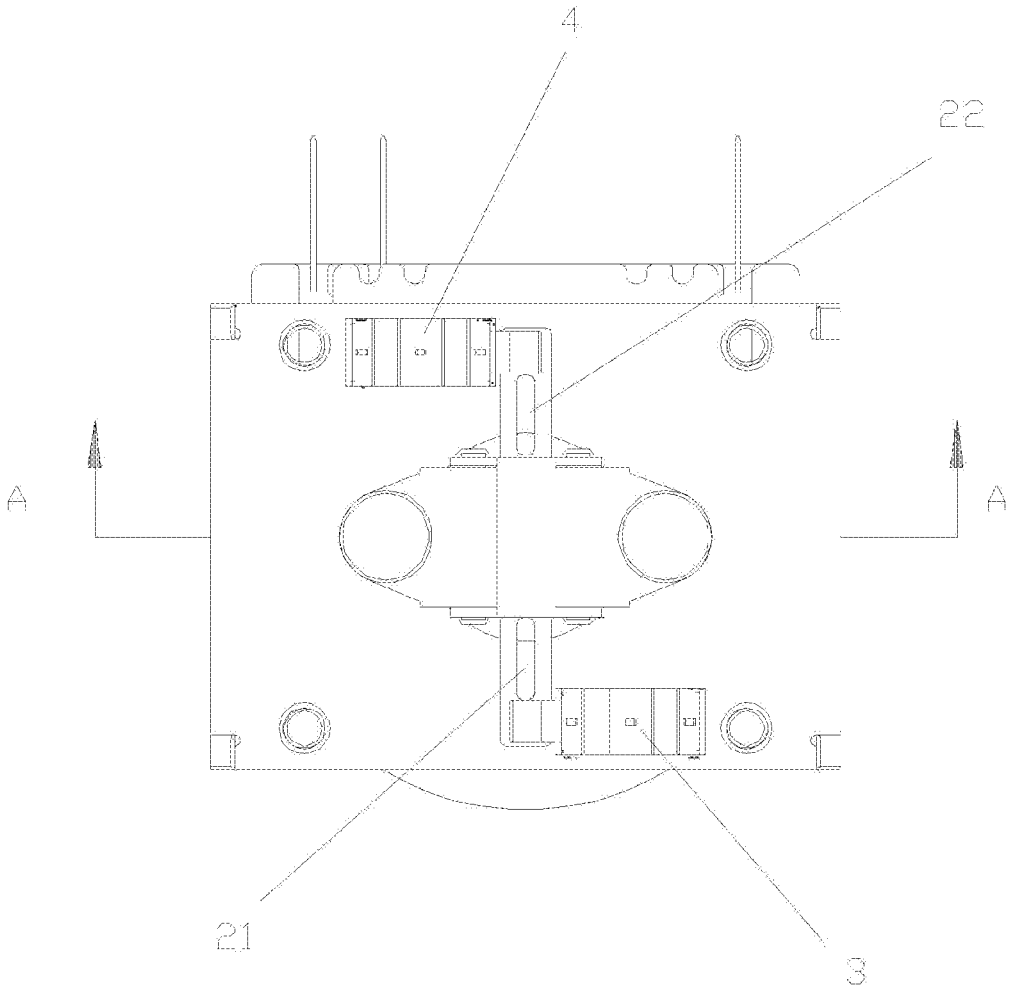
FIG. 2 is a top view of an embodiment (partial configuration) of the present disclosure.
Figure 3:
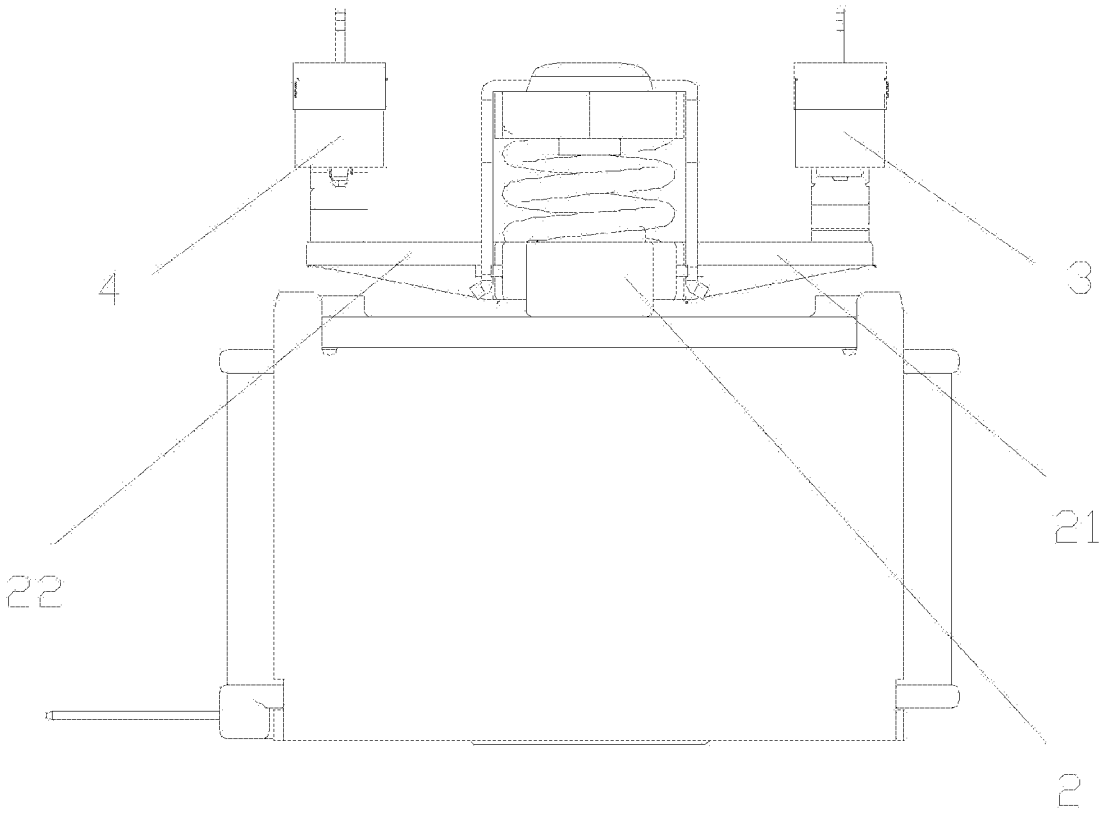
FIG. 3 is a side view of an embodiment (partial configuration) of the present disclosure.

A DC contactor with dual micro switches is provided with two micro switches in an embodiment of the present disclosure, and the two micro switches are respectively matched with the two toggle arms of the push rod, when the main contacts of the contactor are in contact, the two micro switches turns on or off by the toggle arms of the push rod according to a predetermined means, so that the two micro switches play a role as the two sets of auxiliary contacts. Both micro-switches can be used to detect the on-off condition of the main contacts, which plays a dual role of insurance, and also can be used for other needs. Moreover, the on/off condition of the main contacts can be detected by using the on function, the off function, or the contact switching function of the micro switch according to the actual needs of the product.

in this embodiment, one of the two micro switches is used to detect the on/off condition of the main contacts, and the other is used to achieve energy saving.

Referring to FIG. 1 to FIG. 5, a DC contactor with a dual micro switch according to an embodiment of the present disclosure includes a coil 1, a push rod 2 and a first micro switch 3 for detecting an on/off condition of the main contacts, the push rod 2 is provided with a first toggle arm 21, the first micro switch 3 is disposed in the DC contactor and is located at a position correspondingly matched to the first toggle arm 21 of the push rod; the contactor further includes a normally closed second micro switch 4, the coil 1 includes a holding coil 11 and an acceleration coli 12, the acceleration coil 11 and the normally closed second micro switch 4 are connected in series, and the components connected in series the acceleration coli 12 and the normally closed second micro switch 4) are connected in parallel with the holding coil 11; the push rod 2 is provided with a second toggle arm for cooperating with the second micro switch 4 to turn off the power supply of the acceleration coil 12 when the main contacts of the contactor (i.e., the main movable contact and the main stationary contact) are in contact, thereby achieving energy saving.

In this embodiment, the coil 1 is designed to be a structure having an inner ring and an outer ring, the holding coil 11 is the inner ring, and the acceleration coil 12 is an outer ring; the acceleration coil 12 with large power consumption, which has a function of closing the contacts, and the acceleration coil 12 does not operate after the contacts being closed; the holding coil 11 with small power consumption, which has a function of keeping the contacts being closed, thusly keeping the coil 11 being always operated.

When the coil 1 is excited so that the push rod 2 pushes the main movable contact of the contactor to move and contact to the main stationary contact, the first toggle arm 21 of the push rod 2 drives the contact arm of the first micro switch 3 to move, such that the first micro switch 3 could turn on or off, when the main contacts are in contact, the first micro switch 3 can be set to be in an on state, or the first micro switch 3 can be set to be in an off state, which mainly depends on the judgment of the collected signal, therefore, the first micro switch 3 can be a normally closed type, a normally open type or a conversion type; the second toggle arm 22 of the push rod 2 drives the contact arm of the second micro switch 4 to move, such that the second micro switch 4 could turn off Since the second micro switch 4 functions to turn off the circuit when the main contacts are in contact, the second micro switch 4 must be normally closed.

In this embodiment, the push rod 2 includes a spring seat 23 and a rod body 24, one end of the rod body 24 is fixedly connected to the spring seat 23, and the first toggle arm 21 and the second toggle arm 22 are respectively connected to the spring seat 23.

In this embodiment, the contactor also includes a ceramic cover (not shown) in which the main contact is accommodated, the first micro switch 3 and the second micro switch 4 are respectively disposed at two sides of the outside of the ceramic cover, the spring seat 23 of the push rod is also accommodated in the cavity of the ceramic cover, the first toggle arm 21 and the second toggle arm 22 respectively protrude from the cavity of the ceramic cover to two sides of the outside of the ceramic cover and correspondingly cooperate with the first micro switch 3 and the second micro switch 4 respectively.

In this embodiment, the first toggle arm 21, the second toggle arm 22 and the spring seat 23 are integrally connected by injection molding.

In this embodiment, the spring seat 23 also has a fixing piece 25 embedded therein by injection molding.

Figure 4:
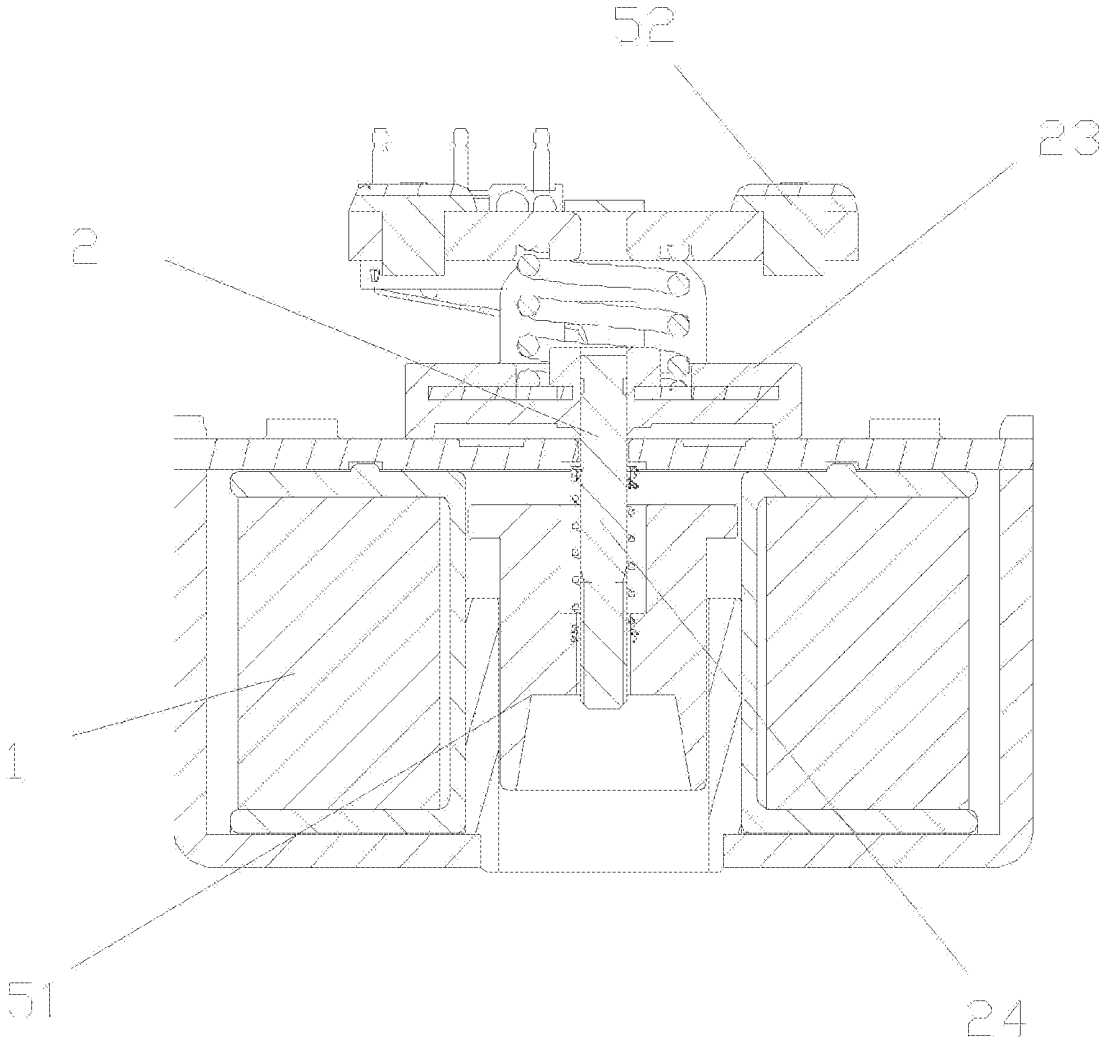
FIG. 4 is a cross-sectional view taken along line A-A of FIG. 2.
Figure 5:
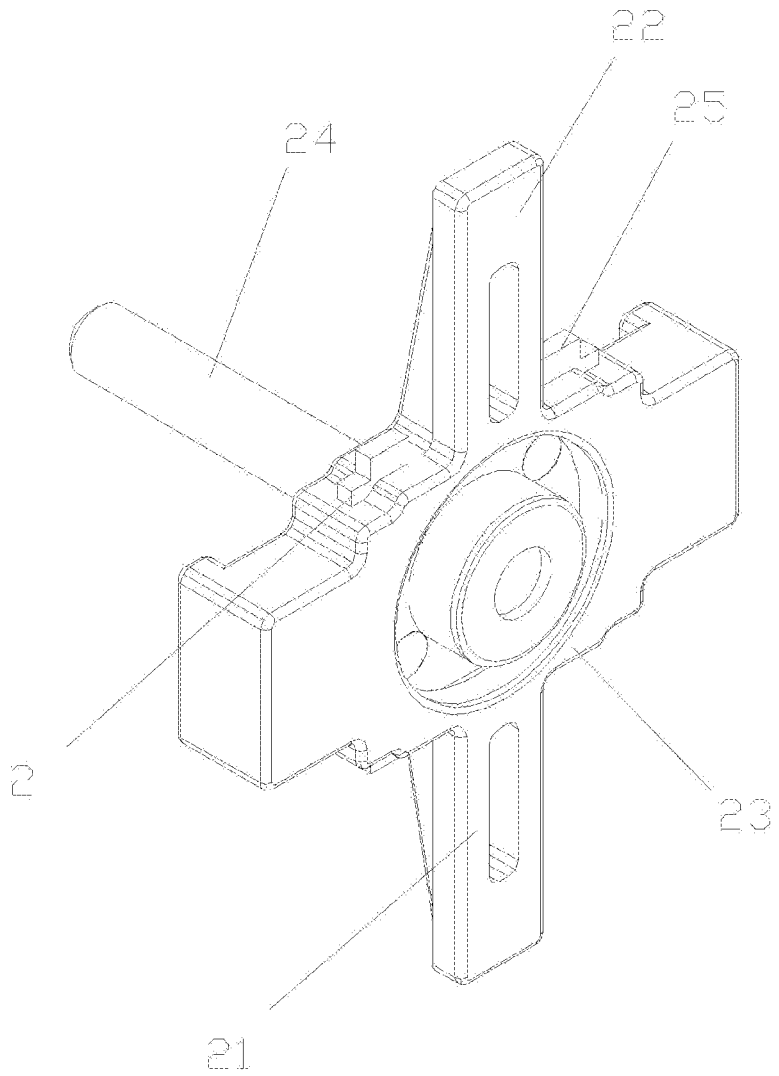
FIG. 5 is a schematic view of the construction of a push rod according to an embodiment of the present disclosure.

As shown in FIG. 4, when the coil 1 is excited, a movable iron core 51 moves upward to drive the push rod 2 to move upward, and the push rod 2 moves upward, such that the main movable contact 52 could move and contact with the main stationary contact, at the same time, the first toggle arm 21 and the second toggle arm 22 at both sides of the push rod 2 also respectively drive the contact arm of the first micro switch 3 and the contact arm of the second micro switch 4 to move, such that the corresponding micro switches will turn on and off.

The first micro switch 3 (equivalent to the first set of auxiliary contacts): when the coil 1 is excited, the movable iron core 51 and the push rod 2 are driven, and the first toggle arm 21 of the push rod 2 drives the contact arm of the first micro switch 3 to move so as to generate an on or off signal, the on/off status of the main contact can be known by the judgment of the board CPU.

The second micro switch 4 (equivalent to the second set of auxiliary contacts) with a normally closed structure: when the coil 1 is excited, the movable iron core 51 and the push rod 2 are driven to move till the main contacts are closed, then the second micro switch 4 turns off, after the second micro switch 4 turns off, the acceleration coil 12 doesn't operate, but only the holding coil 11 operates, thereby achieving the effect of energy saving.

A DC contactor with dual micro switches in embodiment of the disclosure is provided, wherein a normally closed second micro switch 4 is provided, and the coil 1 includes a holding coil 11 and an acceleration coli 12, the acceleration coil 12 and the normally closed second micro switch 4 are connected in series, and the components connected in series are connected in parallel with the holding coil 11; at the same time, the push rod 2 is provided with a second toggle arm 22 for cooperating with the second micro switch 4, when the coli is excited, the push rod 2 is driven to move till the main contacts are closed, then the normally closed second micro switch 4 turns off, after the normally closed second micro switch 4 turns off, the acceleration coil 12 doesn't operate, but only the holding coil 11 operates, thereby achieving the effect of energy saving. The embodiment of disclosure adopts a manner that the second toggle arm 22 of the push rod cooperates with the normally closed second micro switch 4 to achieve the energy saving effect, thereby realizing the elimination of a complicated circuit structure used for performing power saving in a circuit board in the related art, and providing a simpler circuit structure and better applicability.

The above is only a preferred embodiment of the present disclosure and is not intended to limit the disclosure in any way. Although the present disclosure has been disclosed above in the preferred embodiments, it is not intended to limit the disclosure. Any person skilled in the art can make many possible variations and modifications to the technical solutions of the present disclosure or modify the technical solution of the present disclosure to an equivalent embodiment by using the above-disclosed technical contents without departing from the scope of the technical solutions of the present disclosure. Therefore, any simple modifications, equivalent changes, and modifications to the above embodiments in accordance with the teachings of the present disclosure should fall within the scope of the present disclosure.

What is claimed is:

1. A DC contactor with dual micro switches, comprising: a coil, a push rod and two micro switches, the two micro switches are respectively installed at two predetermined positions in the contactor, the push rod is provided with two toggle arms respectively matched with the two micro switches, when main contacts of the contactor are in contact, the two micro switches turn on or off, wherein the two micro switches are respectively a first micro switch for detecting an on/off condition of the main contacts and a second micro switch for realizing energy saving, the second micro switch is a normally closed micro switch, when the coil is excited, the push rod pushes the main movable contact of the contactor to move and contact the main stationary contact, then one toggle arm of the push rod drives a contact arm of the first micro switch to move so as to cause the first micro switch to turn on or off; the other toggle arm of the push rod drives a contact arm of the second micro switch to move so as to cause the second micro switch to turn off.

2. The DC contactor with dual micro switches according to claim 1, characterized in that, one of the toggle arms of the push rod is a first toggle arm, and the other toggle arm is a second toggle arm; the coil comprises a holding coil and an acceleration coil, the acceleration coil and the normally closed second micro switch are connected in series, and the components connected in series are connected in parallel with the holding coil; when the main contacts of the contactor are in contact, the second toggle arm of the push rod drives the contact arm of the second micro switch to move so as to turn off the power supply of the acceleration coil, thereby achieving energy saving.

3. The DC contactor with dual micro switches according to claim 2, characterized in that, the coil is designed to be a structure having an inner ring and an outer ring, the holding coil is the inner ring, and the acceleration coil is the outer ring.

4. The DC contactor with dual micro switches according to claim 2, characterized in that, the push rod comprises a spring seat and a rod body, one end of the rod body is fixedly connected to the spring seat, and the first toggle arm and the second toggle arm are respectively connected to the spring seat.

5. The DC contactor with dual micro switches according to claim 4, characterized in that, the contactor further comprises a ceramic cover in which the main contact is accommodated, the first micro switch and the second micro switch are respectively disposed at two sides of the outside of the ceramic cover, the spring seat of the push rod is also accommodated in the cavity of the ceramic cover, the first toggle arm and the second toggle arm respective protrude from the cavity of the ceramic cover to two sides of the outside of the ceramic cover and correspondingly cooperate with the first micro switch and the second micro switch respectively.

6. The DC contactor with dual micro switches according to claim 4, characterized in that, the second toggle arm and the spring seat are integrally connected by injection molding.

7. The DC contactor with dual micro switches according to claim 6, characterized in that, the spring seat further has a fixing piece embedded therein by injection molding.

8. The DC contactor with dual micro switches according to claim 5, characterized in that, the second toggle arm and the spring seat are integrally connected by injection molding.

9. The DC contactor with dual micro switches according to claim 8, characterized in that, the spring seat further has a fixing piece embedded therein by injection molding.

* * * * *